US009382051B2

(12) United States Patent
Creato

(10) Patent No.: US 9,382,051 B2
(45) Date of Patent: Jul. 5, 2016

(54) HOLDER FOR CORDS, HOSES, AND OTHER ARTICLES

(71) Applicant: Timothy Frost Creato, Edgartown, MA (US)

(72) Inventor: Timothy Frost Creato, Edgartown, MA (US)

(73) Assignee: Creato, Inc., Edgartown, MA (US)

( * ) Notice: Subject to any disclaimer, the term of this patent is extended or adjusted under 35 U.S.C. 154(b) by 263 days.

(21) Appl. No.: 14/046,709

(22) Filed: Oct. 4, 2013

(65) Prior Publication Data

US 2014/0096344 A1 Apr. 10, 2014

Related U.S. Application Data

(60) Provisional application No. 61/710,253, filed on Oct. 5, 2012.

(51) Int. Cl.
*B65D 63/10* (2006.01)
*B65D 85/04* (2006.01)

(52) U.S. Cl.
CPC ..... *B65D 63/1018* (2013.01); *B65D 85/04* (2013.01); *Y10T 24/1498* (2015.01)

(58) Field of Classification Search
CPC ..... Y10T 24/1498; B65D 85/04; B65D 63/1018; B65D 63/18
See application file for complete search history.

(56) References Cited

U.S. PATENT DOCUMENTS

| | | | | |
|---|---|---|---|---|
| 3,601,863 | A * | 8/1971 | Dorsey | 24/16 PB |
| 5,396,684 | A * | 3/1995 | Yocom | 24/16 PB |
| 5,581,850 | A * | 12/1996 | Acker | 24/16 PB |
| 6,073,315 | A * | 6/2000 | Rasmussen | 24/16 PB |
| 6,401,305 | B1 * | 6/2002 | Joseph | 24/16 R |
| 6,523,229 | B2 * | 2/2003 | Severson | 24/16 PB |
| 6,634,063 | B2 * | 10/2003 | Joseph | 24/16 R |

* cited by examiner

*Primary Examiner* — Robert J Sandy
(74) *Attorney, Agent, or Firm* — Stahl Law Firm

(57) ABSTRACT

The present invention relates to holders for securing an elongated, flexible article of manufacture like an electric cord or a hose in a desired configuration, for example, a rolled-up configuration for storage.

14 Claims, 11 Drawing Sheets

HOLDER FOR CORDS, HOSES, AND OTHER ARTICLES

This application claims the benefit of U.S. Provisional Application No. 61/710,253, filed Oct. 5, 2012, which is incorporated herein by reference in its entirety.

1.0 FIELD OF THE INVENTION

The invention relates to holders for easier storage of electrical cords, hoses, and other articles of manufacture.

2.0 BACKGROUND

Some articles of manufacture are stored in a compact configuration, for example, extension cords and hoses are rolled up for storage. Once rolled up, cords and hoses are deposited in a storage area for future use. Leaving cords and hoses in a random configuration for storage would make it more laborious to have the cord or hose readily available for future use. During storage, cords and hoses can get tangled up, making it more cumbersome to use the cord or hose again in the future as it requires first untangling the cord or hose before its next use. It would be desirable to have a convenient and effective holder that allows for easy and convenient storage of cords and hoses, and other long and flexible articles of manufacture. It would also be desirable to have a cord holder that is less likely to get lost during use of the cord, hose, or other article, by having the holder connected to the cord, hose or other article, including during use of the cord, hose or other article. The invention discloses such a holder.

3.0 SUMMARY OF THE INVENTION

The present invention relates to holders for extension cords, hoses and any other article of manufacture that is stored in a compact configuration, for example a rolled-up configuration. A holder of the current invention, in certain embodiments, comprises a cord attachment, a hook, a slot, and/or a grip. In certain embodiments, the body of the holder comprises a loop for cord attachment on one end and a grip on the other end, and one or more slots between the two ends. In certain embodiments, a hook is attached to one side or to both sides of the holder.

A holder of the current invention, in certain embodiments, has the overall shape of a tape with a loop on one end through which the other end of the holder can fit. In certain embodiments, a holder of the invention can attach to a cord, hose or other article by looping one end of the holder around the cord, hose or other article, preferably close to one end of the cord, hose or other article, and by pulling that one end of the holder through the loop on the other end of the holder and by tightening the holder around the cord, hose or other article. In certain other embodiments, a holder of the invention is wrapped around a rolled-up cord, hose or other article by placing a hook of the holder on the outside, or away from the cord, hose or other article, and by wrapping the holder around the rolled-up cord, hose or other article, and by placing a hook of the holder into a slot in the holder so that the hook will hold the holder in place around the rolled-up cord, hose or other article, and thereby hold the cord, hose or other article in a desired configuration, for example a configuration suitable for storage, for example, a compact and/or rolled-up configuration.

A holder of the current invention, and its various components, may be made of any material, for example, a plastic, a metal, a wood, or any other material that is sufficiently strong and flexible. A hook of the holder is preferably made of a strong material and is preferably not flexible, for example, a metal or a strong, inflexible plastic. The parts of the holder other than the hook, in certain embodiments, are made of a material that is flexible, preferably so that the holder will fit around a cord in a manner resulting in a tensile force which keeps the holder in place. In certain other embodiments, a loop of the holder of the invention is made of, or reinforced by, a strong and preferably non-flexible material in those places of the loop that come in contact with a hook of the holder during use.

In certain embodiments, the invention relates to methods for storing an extension cord, a hose or any other article of manufacture with a holder of the current invention.

4.0 BRIEF DESCRIPTION OF THE DRAWINGS

Figure 1:
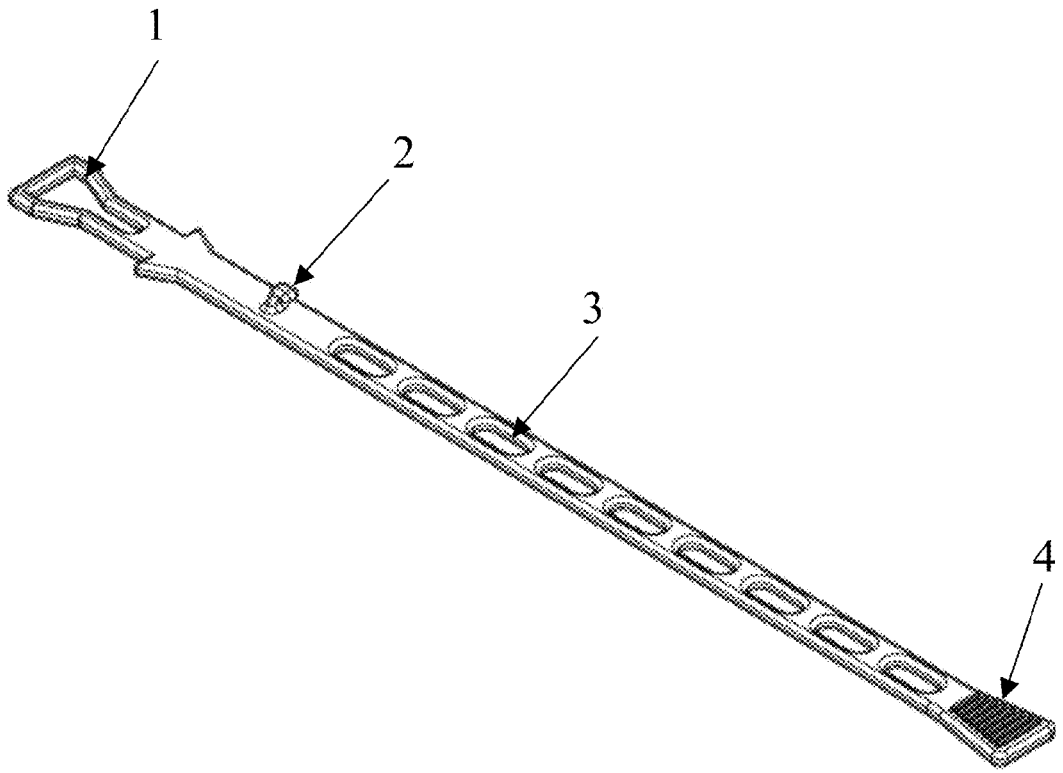
FIG. 1 shows an example of a holder according to certain embodiments of the invention. The numerals used throughout refer to the following: cord attachment (1); hook (2); slot (3); grip (4).
Figure 2:
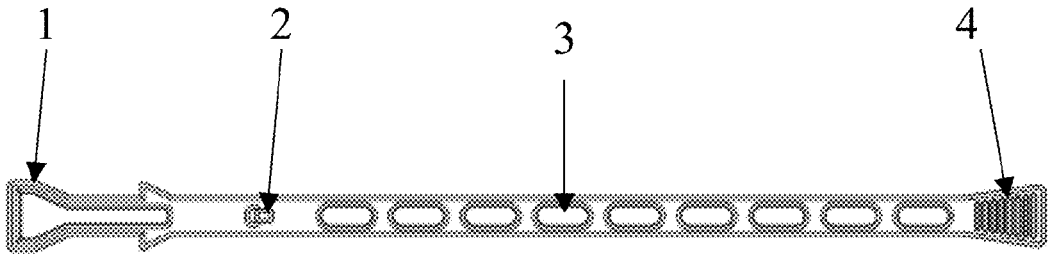
FIG. 2 shows a top view of an example of a holder according to certain embodiments of the invention, including a cord attachment (1), a hook (2), a slot (3), and a grip (4).
Figure 3:
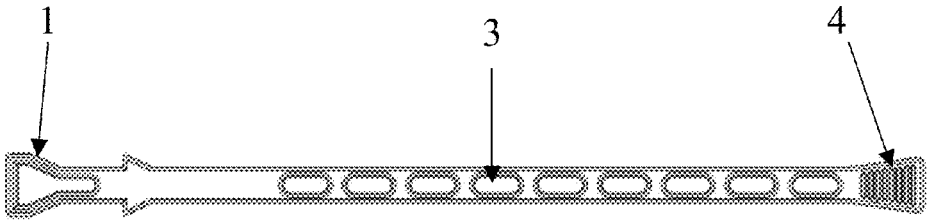
FIG. 3 shows a bottom view of an example of a holder according to certain embodiments of the invention, including a cord attachment (1), a slot (3), and a grip (4).
Figure 4:
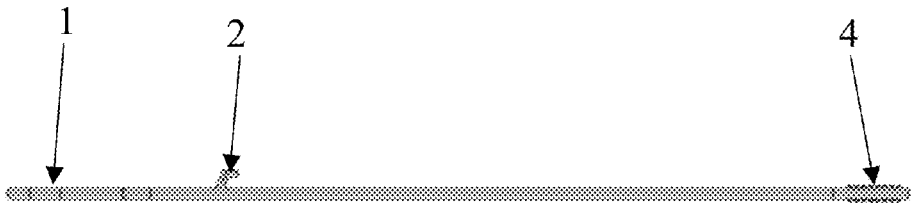
FIG. 4 shows a side view of an example of a holder according to certain embodiments of the invention, including a cord attachment (1), a hook (2), and a grip (4).
Figure 5:
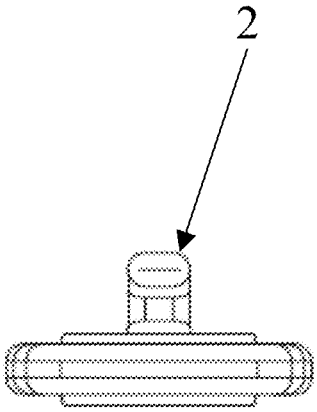
FIG. 5 shows a bottom view of an example of a holder according to certain embodiments of the invention, including a hook (2).
Figure 6:
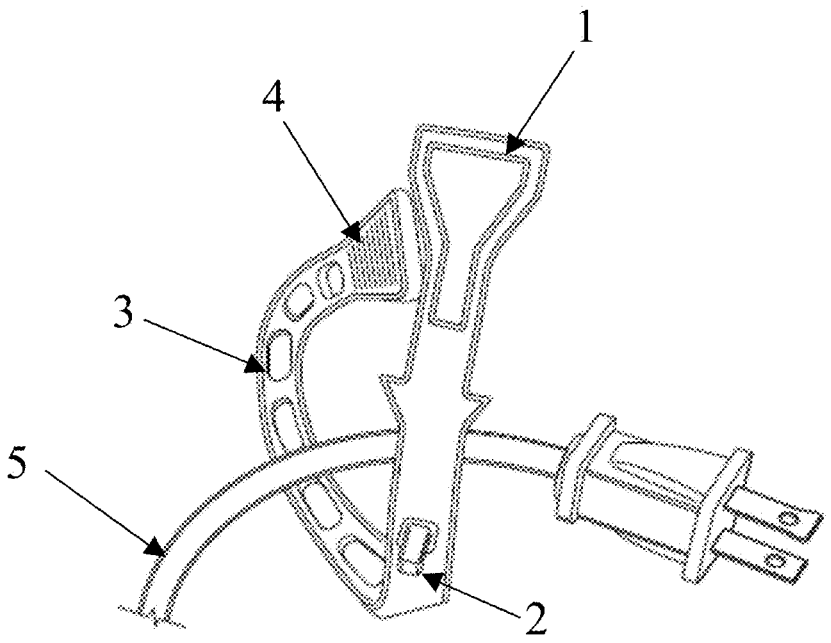

FIG. 6 illustrates how a holder according to certain embodiments of the invention is attached to an article of manufacture, for example, an electric cord (5) as shown in this example. The holder is looped around the cord (5) so that the hook (2) is on the outside (or away from the cord (5)) and the grip (4) is aimed to lead through the cord attachment (1). Also shown are slots (3) of the holder.

Figure 7:
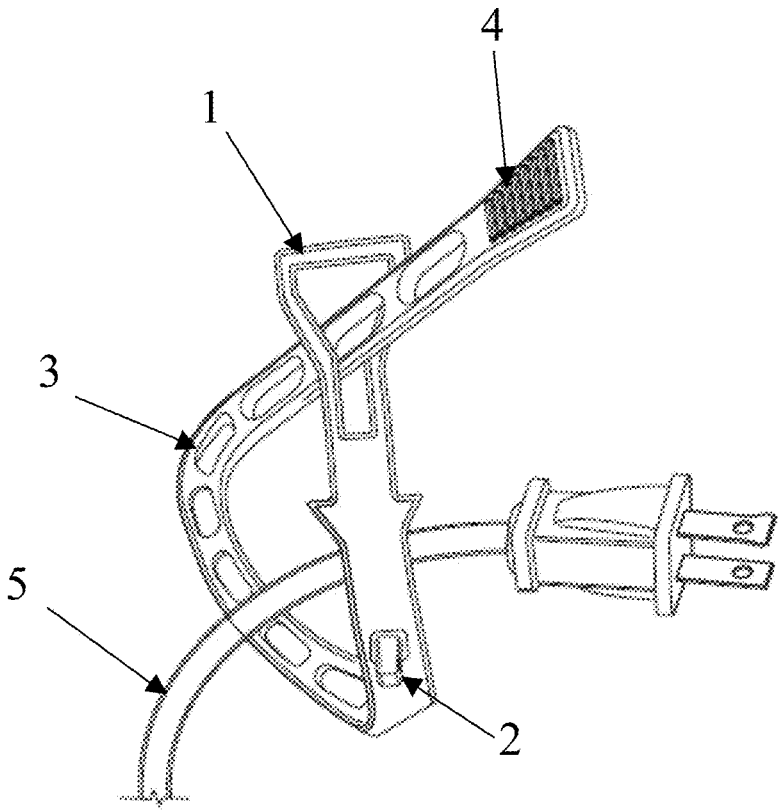

FIG. 7 further illustrates the example shown in FIG. 6. In FIG. 7, the grip (4) was moved through the cord attachment (1). Also shown are a hook (2) and slots (3) of the holder and the cord (5).

Figure 8:
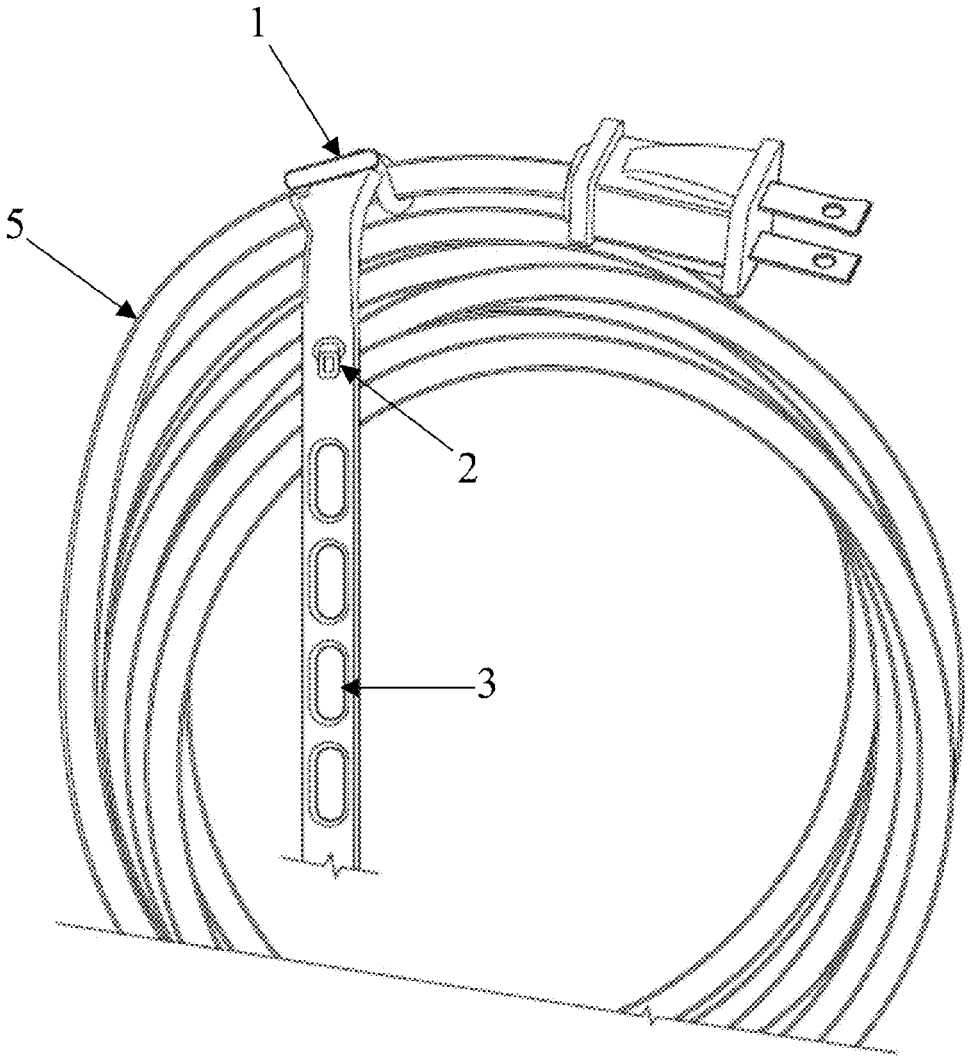

FIG. 8 further illustrates the example shown in FIGS. 6-7. In FIG. 8, the body of the holder with a hook (2) and slots (3) (and the grip (4), which is not shown in FIG. 8) was moved through the cord attachment (1) so that the cord attachment (1) fits tightly around the cord (5). The holder is positioned next to a rolled up cord (5).

Figure 9:
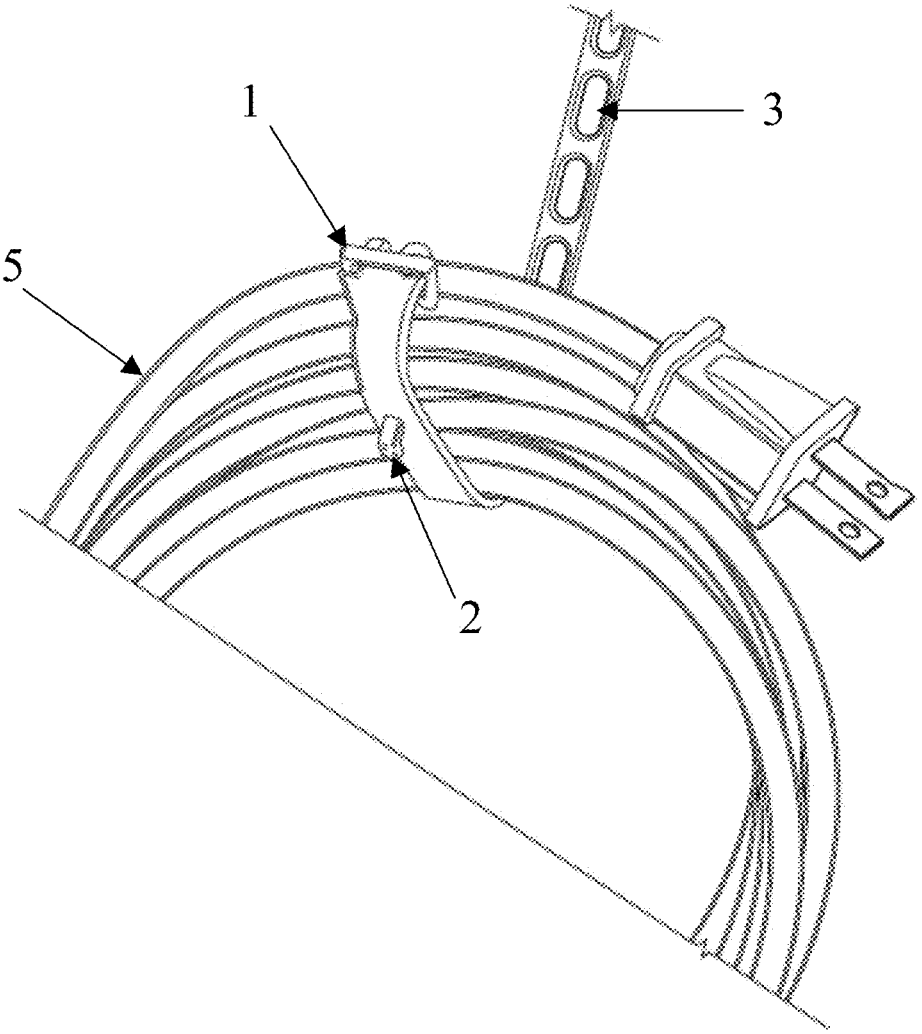

FIG. 9 further illustrates the example shown in FIGS. 6-8. In FIG. 9, the holder is attached to a cord (5) through a cord attachment (1). The body of the holder with a hook (2) and slots (3) (and the grip (4), which is not shown in FIG. 9) is wrapped around the rolled up cord (5).

Figure 10:
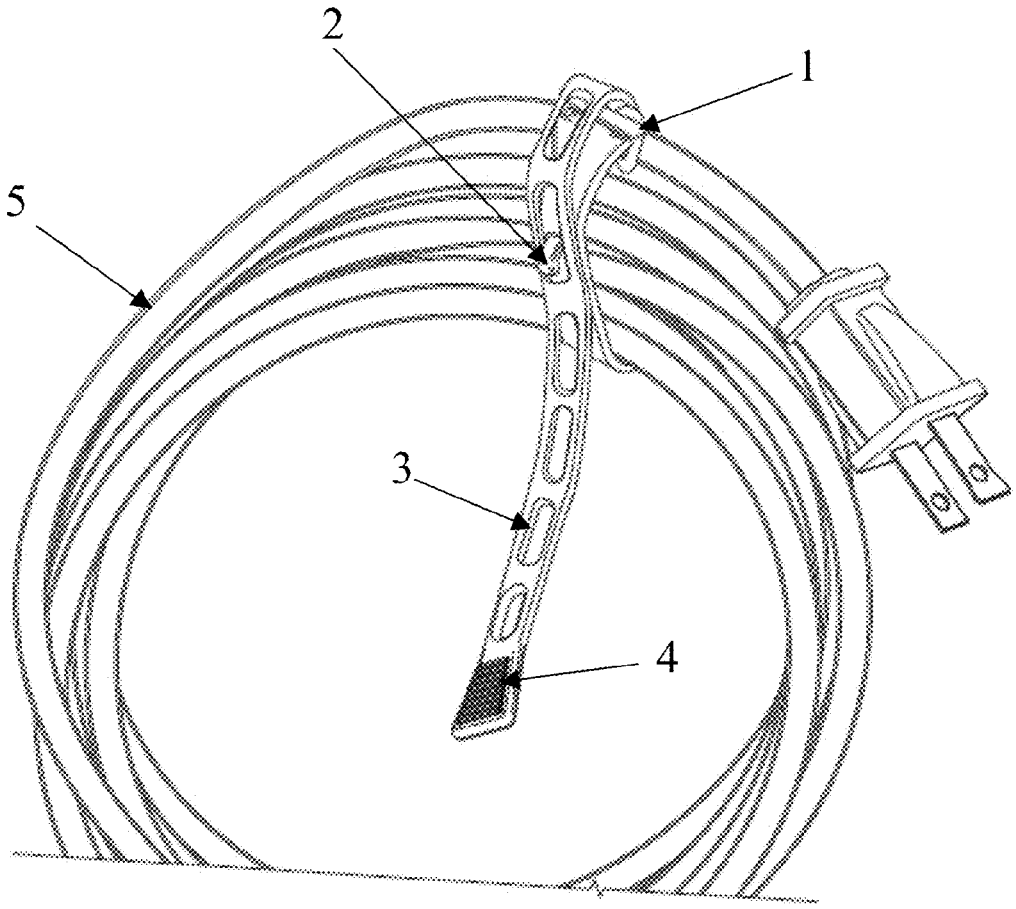

FIG. 10 further illustrates the example shown in FIGS. 6-9. In FIG. 10, the holder is attached to a cord (5) through a cord attachment (1); and the body of the holder with a hook (2), slots (3), a grip (4), is wrapped around the rolled up cord (5). The hook (2) is inserted into one of the slots (3), while the elastic material of the holder is being stretched through force applied by the user.

Figure 11:
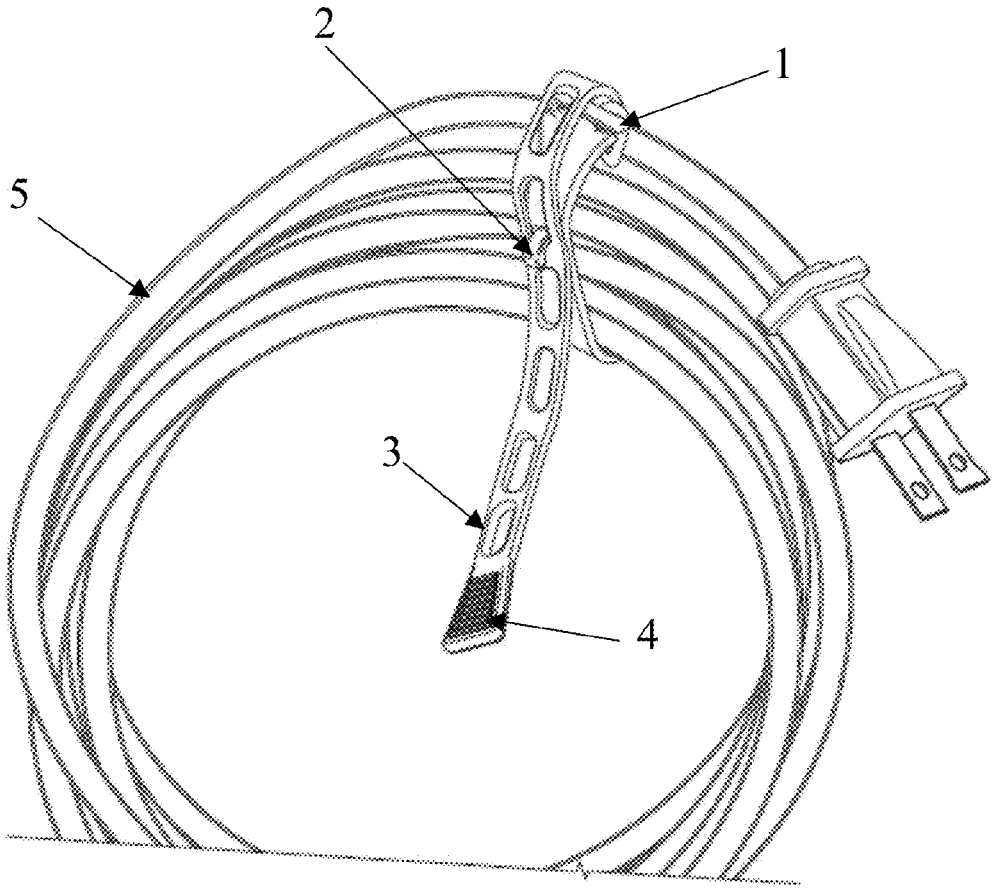

FIG. 11 further illustrates the example shown in FIGS. 6-10. In FIG. 11, the holder is attached to a cord (5) through a cord attachment (1); and the body of the holder with a hook (2), slots (3), a grip (4), is wrapped around the rolled up cord (5). The hook (2) is inserted into one of the slots (3), and the hook (2) rests on the edge of the slot (3). The elastic material of the holder is stretched so that the hook (2) will not slip out of the slot (3).

5.0 DETAILED DESCRIPTION OF THE INVENTION

A holder of the current invention, in certain embodiments, is small, compact, easy to use, and/or durable. In certain embodiments, a holder of the invention stays on the cord, hose, or other article of manufacture on which it is used even when the holder is not used to hold the cord, hose, or article in a desired configuration, for example a rolled-up configuration for storage. A holder of the invention, in certain embodiments, is capable of holding a cord, hose, or other article of manufacture securely together, for example, for storage.

In certain preferred embodiments, a holder of the invention is designed to keep an electrical cord, a hose, or other article of manufacture rolled-up, or coiled up, for example, when not in use and/or for storage. In a preferred embodiment, a holder of the invention attaches to a cord, hose, or other article of manufacture by looping back through itself, for example, by looping the grip end back through the cord attachment loop. In certain preferred embodiments, a holder of the invention attaches to a cord, hose, or other article of manufacture so that the holder will not slide along the cord, hose, or article unless it is being made to slide by applying force. A holder of the invention, in certain embodiments, is locked onto itself by securing a hook of the holder through a slot in the holder. A holder of the invention is preferably made of an elastic material, for example a material similar to, or like, a material useful for a bungee cord. In certain embodiments, a hook of a holder of the invention is made of a material that is more rigid than other parts of the holder, for example a rigid material or a semi-rigid material that is more rigid than a material selected for other parts of the holder. In certain other embodiments, a surface defining a slot of a holder of the invention may be made of a material that is more rigid than other parts of the holder, for example a rigid material or a semi-rigid material that is more rigid than a material selected for other parts of the holder. In certain embodiments, a hook and wall defining a slot of a holder of the invention are made of a material with the same rigidity or a similar or closely-similar rigidity.

When in use, a holder of the invention will keep a cord, hose, or other article in a rolled-up configuration because the tension in the elastic material of the holder will keep a hook of the holder hooked into a slot in the holder so that the holder will fit tightly around the cord, hose, or other article, and thereby not allow the cord, hose, or other article to unfold from a rolled-up configuration. A holder of the invention, in certain embodiments, is used by coiling up a cord, a hose, or another article of manufacture, and by wrapping the holder around the cord, or hose, or article, and by inserting a hook of the holder into a slot of the holder.

The dimensions of holder of the invention depend in part on the application. A holder useful for securing a long cord, hose, or other article, will need to be longer than a holder useful for securing a short cord, hose, or other article. A holder may be longer than the minimum length needed to use it for securing a cord, hose, or other article. In certain embodiments, a holder of the invention is 5-90 centimeter (cm) in length, or 10-40 centimeter, or 15-30 centimeter, or 20-40 centimeter, or 25-50 centimeter. A holder of the invention, in certain embodiments, is 0.5-8 centimeters in width, or 0.5-3 centimeters, or 1-2 centimeters, and preferably 1 centimeter or 1.5 centimeters in width. A holder of the invention, in certain embodiments, comprises a cord attachment, preferably on one end. A cord attachment, in certain embodiments, is 1-8 centimeters in length, or 1-4 centimeters, or 1.5-4 centimeters, or 2-3 centimeters, when measuring the maximum length of the opening (or loop) of the cord attachment. A holder of the invention, in certain embodiments, comprises a grip, preferably on one end. A grip, in certain embodiments, is 1-8 centimeters in length, or 1-4 centimeters, or 1.5-4 centimeters, or 2-3 centimeters, when measuring the maximum length of the grip.

A holder of the invention preferably has one or more slots so that a hook of the holder can be secured in a slot, while generating sufficient tension to secure the holder without over-stretching the material of the holder. In certain embodiments, a holder of the invention has one hook on one side of the holder, but a holder may have two hooks, which may be on one or both sides of the holder, and a holder may have three, four, or more hooks, which may be on one or both sides of the holder. In certain other embodiments, a holder of the invention may comprise one slot, or two slots, three slots, four slots, five slots, six slots, seven slots, eight slots, nine slots, ten slots, eleven slots, twelve slots, thirteen slots, fourteen slots, fifteen slots, or more, or 1-20 slots, or 5-20 slots, or 5-15 slots, or 7-12 slots. The size of the slot in a holder of the invention is sufficient to insert a hook of the holder through the slot. The slots of a holder of the invention may be the same in size or they may vary in size, and the slots may be equally spaced in the holder or the spacing of the slots may vary. In certain embodiments, a slot of a holder of the invention has a width that is 20-80 percent of the width of the holder, or 30-70 percent, or 40-60 percent, or 50 percent. In certain embodiments, a slot of a holder of the invention is a circle, or it is greater in length than in width by 10-500 percent, or by 30-400 percent, or by 50-300 percent, or by 50-200 percent, or by 100-200 percent. In certain embodiments, a slot of a holder of the invention is 0.5-5 centimeters long, or 1-3 centimeters, or 1.5-2.5 centimeters, or 1.8 centimeters. In certain embodiments, a slot of a holder of the invention is 0.3-3 centimeters wide, or 0.4-1.5 centimeters, or 0.5-0.8 centimeters, or 0.6 centimeters. In certain embodiments, the spacing between slots of a holder of the invention is 0.3-8 centimeters, or 0.5-5 centimeters, or 0.5-3 centimeter, or 0.5-2 centimeters, or 0.5-1 centimeters, or 0.6 centimeters.

A holder of the invention, in certain embodiments, can be made of plastics that are elastic, transparent, and/or resistance to oil, grease and/or abrasion. A holder of the invention, in certain preferred embodiments, is made of a thermoplastic polyurethane (abbreviated TPU), a thermoplastic elastomer comprising linear segmented block copolymers composed of hard and soft segments. In certain embodiments, a material, such as a TPU, for use in a holder of the invention may be processed in manner known to the skilled artisan. A TPU resin useful for making a holder of the invention, in certain embodiments, may be used in the form of a pellet and may be pre-dried in a desiccant dryer or oven at 190 to 220 F, depending upon hardness of TPU selected. Then, in certain embodiments, it may be processed using standard plastic injection molding equipment. An example of a TPU for making a holder of the invention, in certain embodiments, is Texin made by Bayer Corporation, which may be obtained from Bay State Polymer (Westlake, Ohio, USA).

A hook of a holder of the invention is preferably made of a strong material and is preferably not flexible, for example, a metal or a strong, inflexible plastic. Examples of materials for making a hook of a holder of the invention include a rigid plastic, a semi-rigid plastic, a composite, and/or a metal. A hook of a holder of the invention according to certain embodiments may be embedded in the holder when the holder is molded, or the hook may be fastened to the holder after the holder is molded.

In certain embodiments, a holder of the invention is made through any manufacturing method known in the art, for example, injection molding. Where injection molding is used to make a holder of the invention, the material for injection molding, which may be in pellet form, is placed in a material bin, also known as a hopper and located at the top of the machine, of a molding machine. From the material bin, or hopper, the material drops down into a heated cylinder, also known as the barrel. The barrel contains a large rotating screw that melts the plastic and forces it to the front of the machine. After the plastic is melted the plastic is hydraulically or electrically forced into a small orifice located on the back side of a cold steel mold. Inside the mold contains the machined profile or shape of the part. After the plastic is injected into the mold, it cools by cold water flowing through water channels that are machined into the mold. After cooling, the mold opens and ejects the part(s) out of the mold with a mechanical ejecting system.

Examples of injection molding for making a holder of the invention include two types of injection molds known as cold runner and hot runner molds. In cold runner molds, plastic is injected directly from the machine into the mold. In hot runner molds, a heated manifold inside the mold is used to hold and heat material for the next cycle, thus allowing for a faster and more accurate cycle than the cold runner method. Hot runner molds typically cost more than cold runner molds due to their higher complexity and increased number of parts, and they take more time to design than cold runner molds. Hot runner molds also tend to require more maintenance than cold runner molds. A type of mold that is a combination of a cold and hot runner is called a hot tip bushing mold, which includes a heated gate that allows injecting the material right into the mold cavity, and thereby eliminating the runners and sprues which transfer material into the part cavity in cold runner systems.

The present invention is not to be limited in scope by the specific embodiments described herein, which are intended as single illustrations of individual aspects of the invention, and functionally equivalent methods and components are within the scope of the invention. Indeed, various modifications of the invention, in addition to those shown and described herein, will become apparent to those skilled in the art from the foregoing description. Such modifications are intended to fall within the scope of the appended claims. All cited publications, patents, and patent applications are herein incorporated by reference in their entirety for any purpose.

What is claimed is:

1. A holder for use in securing an elongated, flexible article of manufacture in a rolled-up configuration comprising a cord attachment, a hook, slots, and a grip, wherein the holder is made of a flexible material, wherein the hook is made of a rigid material, wherein the hook is attached to the body of the holder by being embedded in the holder, wherein the grip fits through an opening in the cord attachment, and wherein the hook fits through the slots.

2. A holder according to claim 1, wherein said holder is 10-40 centimeter in length.

3. A holder according to claim 1, wherein said holder is 0.5-3 centimeter in width.

4. A holder according to claim 1, wherein said holder comprises 5-20 slots.

5. A holder according to claim 1, wherein said slots are 50-300 percent greater in length than in width.

6. A holder according to claim 5, wherein said slots are 1-3 centimeters in length.

7. A holder according to claim 1, wherein spacing between said slots is 0.5-3 centimeters.

8. A method for securing an elongated, flexible article of manufacture in a rolled-up configuration comprising securing said article of manufacture with a holder comprising a cord attachment, a hook, slots, and a grip, wherein the holder is made of a flexible material, wherein the hook is made of a rigid material, wherein the hook is attached to the body of the holder by being embedded in the holder, wherein the grip fits through an opening in the cord attachment, and wherein the hook fits through the slots.

9. A method according to claim 8, wherein said holder is 10-40 centimeter in length.

10. A method according to claim 8, wherein said holder is 0.5-3 centimeter in width.

11. A method according to claim 8, wherein said holder comprises 5-20 slots.

12. A method according to claim 8, wherein said slots are 50-300 percent greater in length than in width.

13. A method according to claim 12, wherein said slots are 1-3 centimeters in length.

14. A method according to claim 8, wherein spacing between said slots is 0.5-3 centimeters.

* * * * *